US008764131B2

(12) United States Patent
Risley

(10) Patent No.: US 8,764,131 B2
(45) Date of Patent: Jul. 1, 2014

(54) UNDERCABINET SECRETARY WITH HIDDEN COMPARTMENT

(76) Inventor: Marie Risley, Las Vegas, NV (US)

( * ) Notice: Subject to any disclaimer, the term of this patent is extended or adjusted under 35 U.S.C. 154(b) by 306 days.

(21) Appl. No.: 13/277,430

(22) Filed: Oct. 20, 2011

(65) Prior Publication Data

US 2013/0099632 A1 Apr. 25, 2013

(51) Int. Cl.
*A47B 17/04* (2006.01)

(52) U.S. Cl.
USPC ..... 312/204; 312/245; 312/328; 220/533

(58) Field of Classification Search
USPC ..... 312/245, 204, 352, 257.1, 260, 312/263–265, 265.3, 265.5–265.6; 211/184; 220/529, 551, 552, 528, 522, 220/521, 525, 507, 503, 533; 109/54
See application file for complete search history.

(56) References Cited

U.S. PATENT DOCUMENTS

| | | | | | |
|---|---|---|---|---|---|
| 144,769 | A * | 11/1873 | Kade | 312/204 |
| 513,061 | A * | 1/1894 | Slater | 312/204 |
| 821,167 | A * | 5/1906 | Hurt et al. | 312/204 |
| 1,281,923 | A * | 10/1918 | Fales | 312/317.2 |
| 3,332,729 | A * | 7/1967 | Dickson | 312/204 |
| 3,489,475 | A * | 1/1970 | Boyce et al. | 312/183 |
| 4,095,860 | A * | 6/1978 | Henson | 312/242 |
| 4,429,932 | A * | 2/1984 | Brennan | 312/259 |
| 4,779,752 | A * | 10/1988 | Vallee et al. | 220/533 |
| 4,807,760 | A * | 2/1989 | Sussman | 206/581 |
| 4,901,651 | A * | 2/1990 | Herron | 109/54 |
| 4,925,255 | A * | 5/1990 | DeBlaay | 312/204 |
| 5,048,901 | A * | 9/1991 | DeBlaay | 312/204 |
| 5,103,998 | A * | 4/1992 | Caro et al. | 220/533 |
| 5,131,732 | A * | 7/1992 | Lane et al. | 312/190 |
| 5,597,219 | A * | 1/1997 | Horn et al. | 312/330.1 |
| 5,603,558 | A * | 2/1997 | Zimmer | 312/290 |
| 5,813,735 | A * | 9/1998 | Wu | 312/204 |
| 5,826,730 | A | 10/1998 | Stravitz | |
| 6,030,059 | A * | 2/2000 | Stravitz | 312/9.47 |
| 6,073,794 | A * | 6/2000 | Bidot | 220/529 |
| 6,874,624 | B2 | 4/2005 | Redzisz | |
| 2002/0067108 | A1 * | 6/2002 | Doan et al. | 312/204 |
| 2005/0264141 | A1 * | 12/2005 | Whitall | 312/204 |
| 2008/0290767 | A1 * | 11/2008 | Rimback et al. | 312/223.1 |
| 2010/0276241 | A1 | 11/2010 | Malone | |
| 2012/0206029 | A1 * | 8/2012 | Zabbatino | 312/404 |

* cited by examiner

*Primary Examiner* — Darnell Jayne
*Assistant Examiner* — Ryan A Doyle
(74) *Attorney, Agent, or Firm* — Lightbulb IP, LLC

(57) ABSTRACT

An undercabinet secretary provides organization and storage for items as well as concealed or hidden storage for items. The undercabinet secretary prevents concealed items from being accessed while allowing authorized persons or those who are aware of the hidden storage to conveniently retrieve the items. The undercabinet secretary may have one or more dividers to provide compartments for organization and storage of items, and may have a hidden compartment assembly having the same outward appearance to conceal items. In one or more embodiments, the hidden compartment assembly may have its own divider which may be used as a handle to access the hidden compartment assembly and which allows the hidden compartment assembly to blend in with the other dividers.

19 Claims, 7 Drawing Sheets

UNDERCABINET SECRETARY WITH HIDDEN COMPARTMENT

BACKGROUND OF THE INVENTION

1. Field of the Invention

The invention relates to storage furnishings and in particular to an undercabinet secretary with a hidden compartment.

2. Related Art

Traditional storage furnishings provide organization and storage for various items a person accumulates throughout life, making it easy for the person and others to find and retrieve these items. For example, file cabinets, shelves, and drawers are often used to store papers and other items for safekeeping and for organization purposes. Likewise, traditional secretaries provide individual compartments for storage of items. For example, a set of compartments may be provided for storage of envelopes while another set of compartments may be provided for storage of incoming or outgoing mail.

In some cases, storage furnishings, such as the cabinets, shelves, and drawers mentioned above fail to provide adequate storage to an ever growing collection of a person's items. In such case, traditional storage furnishings might be supplemented or replaced. In the case of a file cabinet for example, another file cabinet may be purchased to increase capacity. Alternatively or in addition, the file cabinet may be replaced with one having a larger capacity.

From the discussion that follows, it will become apparent that the present invention addresses the deficiencies associated with the prior art while providing numerous additional advantages and benefits not contemplated or possible with prior art constructions.

SUMMARY OF THE INVENTION

An undercabinet secretary having a hidden compartment assembly is disclosed herein. The undercabinet secretary allows for organization and storage of concealed and unconcealed items. To those aware of the hidden compartment assembly, concealed items may be easily retrieved, and items that should be concealed may be easily placed within a holder of the hidden compartment assembly. To those unaware of the hidden compartment assembly, the location of concealed items and the hidden compartment assembly is difficult if not impossible to discern due to the construction of the undercabinet secretary. The undercabinet secretary also may include one or to more installation tools that allow it to be easily installed and removed by a single person.

The undercabinet secretary may have a variety of configurations. For example, in one embodiment the undercabinet secretary may comprise a base comprising one or more first channels, a top comprising one or more second channels, and one or more dividers held by at least one of the first channels and at least one of the second channels and extend therebetween.

A holder having a front and a back and configured to hold one or more items may be provided as well. An additional divider may extend from the front of the holder. The additional divider may be by at least one of the first channels and at least one of the second channels and extend therebetween. The additional divider may be movable along the at least one of the first channels and the at least one of the second channels to permit the holder to be moved into and out of the undercabinet secretary. In addition, the additional divider may have a height taller than that of the holder so that the additional divider may extend into at least one of the first channels and the at least one of the second channels.

It is noted that one or more side panels may extend between the base and the top at one or more lateral ends of the base and the top. In addition a back panel may extend between the base and the top at a back end of the base and the top. The back panel and/or one or more side panels may be used to enclose or form an enclosure of the undercabinet secretary.

To help conceal the holder, the overall length of the additional divider and the holder may be the same as a length of the dividers. In this manner, the additional to divider may be positioned similarly to the other dividers (e.g., flush with the front end of the undercabinet secretary) thus concealing the additional divider. Likewise, the holder may extend a lateral distance across the base to end at one of the second channels. This prevents the holder from extending beyond a divider and partially into a compartment formed by the divider where the holder could be easily visible.

In another exemplary embodiment, an undercabinet secretary may comprise an enclosure having a top, a bottom, and two sides where the top and the bottom both have a front end and a back end. A front may be pivotably mounted to the front end of the base. One or more first channels may be in the top and extend from the front end to the back end of the top. One or more second channels may be in the bottom and extend from the front end to the back end of the bottom. The first channels and the second channels may be open towards each other. In other words, the top and bottom may be oriented such that the first and second channels open towards one another. One or more dividers may extend between the top and the bottom to form one or more compartments.

A hidden compartment assembly comprising a holder having an additional divider extending outward therefrom will typically be included as well. The additional divider may have a top end and a bottom end with the top end within at least one of the first channels and the bottom end within at least one of the second channels. For example, the additional divider is a planar structure that can be accepted within the first and second channels. The additional divider may be slidable within the at least one of the first channels and the at least one of the second channels.

This allows the hidden compartment assembly to move within the undercabinet secretary. The other dividers may not be movable. For example, these dividers may be attached or secured to the top and the bottom, while the additional divider is within the at least one of the first channels and the at least one of the second channels. It is noted that the length of the additional divider may be shorter than the length of the dividers to allow the hidden compartment assembly to be concealed within the undercabinet secretary.

Various methods of concealing one or more items with an undercabinet secretary are disclosed herein as well. For example, in one embodiment a method of concealing one or more items with an undercabinet secretary may comprise placing a hidden compartment assembly comprising a holder having a divider extending outward therefrom within an enclosure having one or more compartments formed by one or more additional dividers therein.

A front end of the additional dividers may be positioned at a front end of the enclosure, and a front end of the divider may be positioned at the front end of the enclosure to conceal the hidden compartment assembly within the enclosure. This may occur by moving the divider within one or more channels formed in a top and a bottom of the enclosure. The hidden compartment assembly may be moved out of the enclosure to remove and/or place one or more items from/into the holder.

The method may include an installation procedure. For example, the method may include shortening a support strut of an installation tool, and pivoting a base of the installation tool relative to the support strut such that the support strut extends substantially perpendicular to the base. The enclosure may then be supported at a particular location with the support strut of the installation tool. The enclosure may then be secured at the particular location with one or more fasteners, and the installation tool may then be removed.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the undercabinet secretary herein provides the advantages of organization, storage, and easy access for papers and other items, while preventing access or restricting access to certain items. Thus, with the undercabinet secretary to herein a user may store items such that they are organized, and in addition, may choose which items are readily accessible and which are not. In addition, the undercabinet secretary may be configured as an add-on or enhancement to an existing furnishing. Once installed, as will be described herein, the undercabinet secretary enhancing the storage and organization capabilities, while also providing security or restricted access for some of a user's items.

Figure 1A:
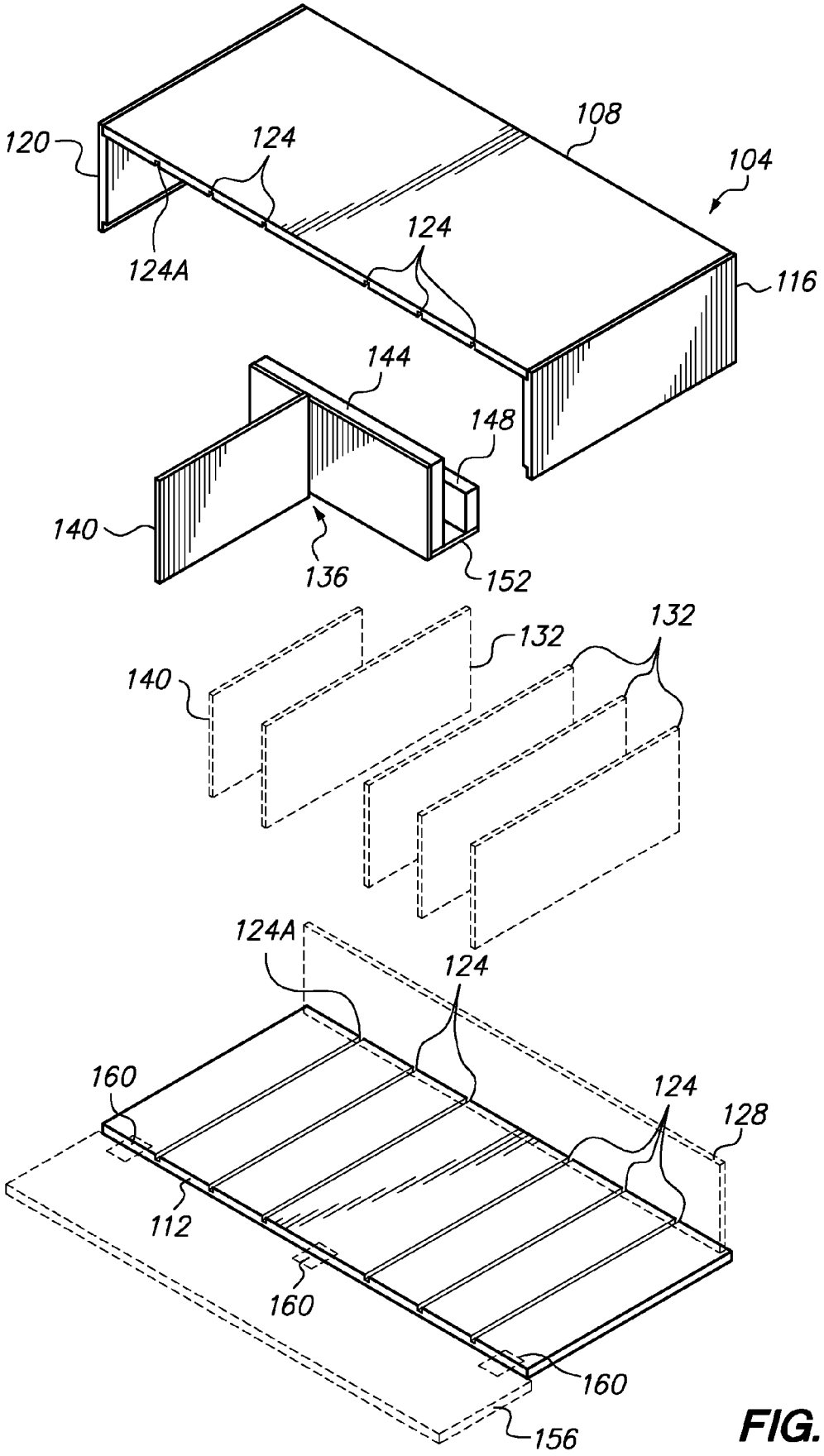
FIG. 1A is an exploded view of an exemplary undercabinet secretary.

The undercabinet secretary will now be described with regard to FIGS. 1A-1B. FIG. 1A is an exploded view of the undercabinet secretary 104 from a front perspective. As can be seen, the undercabinet secretary 104 may have a base 112, one or more sides 116,120, and a top 108. As can also be seen, these components may be panels or the like.

It is noted that one or more of these components may be optional. For example, FIG. 1A illustrates an optional back 128 and an optional front 156 (both configured as panels as well), as shown by the broken lines used to illustrate them. It is noted that the back 128 may be optional in cases where the undercabinet secretary 104 is installed with its back against a wall or other structure. The front 156 may be optional as a cover for the undercabinet secretary 104. For instance, the front 156 may be used to prevent access to one or more compartments 164 (see FIG. 1B) of the undercabinet secretary 104. In FIG. 1A, the front 156 is pivotably mounted, such as via one or more hinges 160 to allow the front 156 to open and close. It is contemplated that the front 156 may open in various ways, and that the front may have a locking mechanism to secure it in a closed position to prevent access to one or more compartments 164 of the undercabinet secretary 104.

In one or more embodiments, the top 108 and bottom 112 of the undercabinet secretary 104 may comprise one or more channels 124 or grooves. In general, these channels 124 provide a structure which accepts one or more dividers 132 that form the walls of a compartment 164. The dividers 132 may be planar structures having a top end and a bottom end that engage channels 124 of the top 108 and bottom 112, such as shown. It is noted that the top and/or bottom end of a divider 132 may be thinner or thicker than the center or middle portion of the divider to match the size of a channel 124. The divider 140 of the hidden compartment assembly 136 may be configured in the same or a similar manner.

Figure 1B:
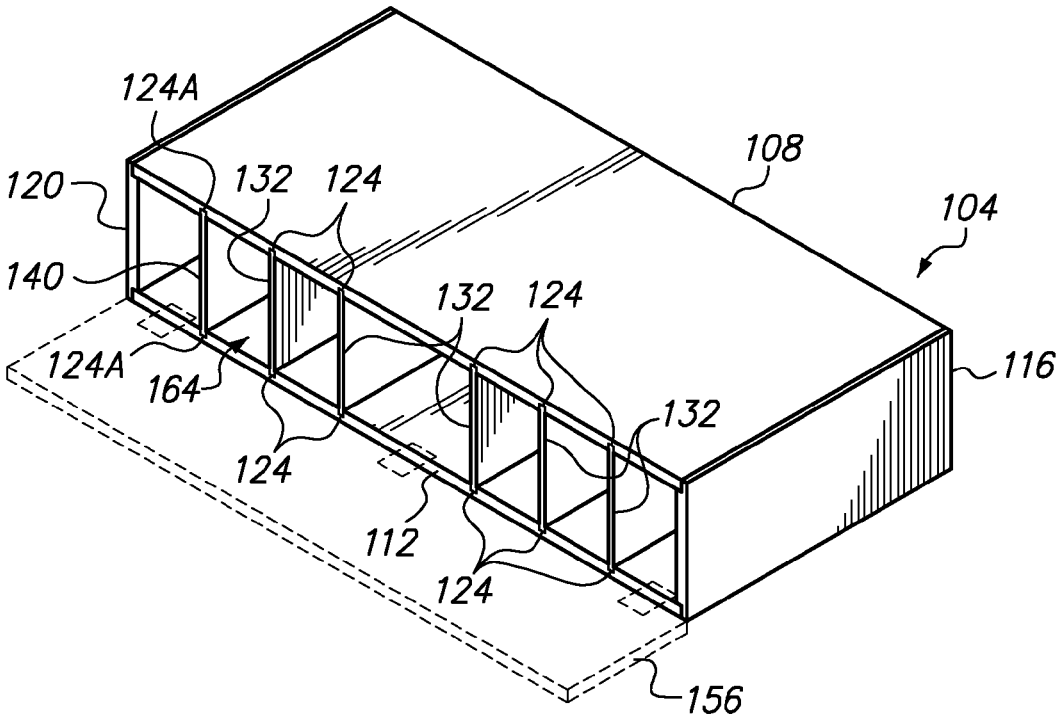
FIG. 1B is a perspective view of an exemplary undercabinet secretary.

As can be seen from FIG. 1B, a pair of channels 124 at the top 108 and bottom 112 may hold the top and bottom end of a divider 132 to secure it in position. The channels 124 may be grooves, such as stated above, or may be similar structures that can secure a top and/or bottom end of a divider. The channels 124 may be embedded into the top 108 or bottom 112 or may be constructed on a surface thereof. In addition, the channels 124 may be spaced at uniform or non-uniform distances to form compartments 164 of varying size. For example, as shown, the central channels 124 are spaced further apart than those around it in FIGS. 1A-1B.

The channels 124 provide another benefit in that they may also be used to secure a hidden compartment assembly 136. As can be seen, the hidden compartment assembly 136 may comprise a divider 140 like those described above. This is highly advantageous in that it helps conceal the hidden compartment assembly 136. As can be seen from the assembled view of FIG. 1B, the divider 140 of the hidden compartment assembly 136 can appear no different than the other dividers 132 of the undercabinet secretary 104. This prevents the hidden compartment assembly 136 to from being noticed or identified.

Like the other dividers 136, the divider 140 of the hidden compartment assembly 136 may be engaged by at least one channel 124 of the top 108 and/or bottom 112. This can be seen from FIG. 1C, which illustrates a top view of the undercabinet secretary 104 with the top 108 removed. As can be seen, the divider 140 of the hidden compartment assembly 136 engages a channel 124A of the bottom 112 and is held by the channel Referring to FIGS. 1A and 1B, it can be seen that a top end of the divider 140 may also be engaged with a channel 124A in the top 108 of the undercabinet secretary 104.

The hidden compartment assembly 136 may also include a compartment, container, or other holder 144 for storing items. In general, the holder 144 will store such items in a concealed manner such that they cannot be readily found or accessed except by those authorized to do so. The holder 144 may be attached to a back end of the divider 140 and thus be accessible by moving the divider, as will be described further below.

Figure 1C:
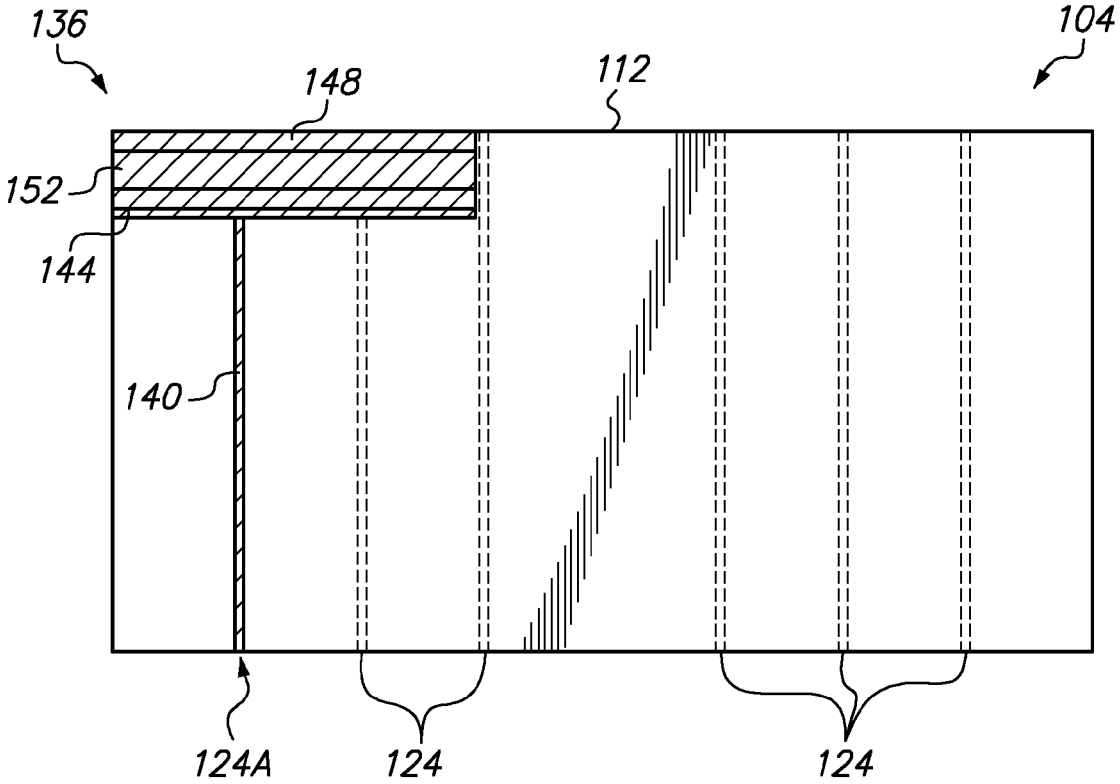
FIG. 1C is a top interior view of an exemplary undercabinet secretary.

As can be seen in FIG. 1C, the holder 144 may occupy a portion at the rear or back of the undercabinet secretary 104. This is beneficial in that it provides space within the undercabinet secretary 104 for the holder 144 to store items. Also, this is beneficial in that the holder 144 is not readily identifiable when the undercabinet secretary 104 is assembled, such as shown in FIG. 1B. Even if a person were to look directly into one or more compartments 164 of the undercabinet secretary 104 it would be difficult or impossible to discern the existence of the holder 144. This is especially so where the front surface 152 of the holder 144 is made to appear like or made from the same material as a back 128 of the undercabinet secretary (or the wall or other surface at the back end of the undercabinet secretary). For example, front surface 152 of the holder 144 may comprise wood, drywall, plaster, wallpaper, or the like to allow it to appear the same as or similar to the materials at the back end of the undercabinet secretary 104.

Figure 2:
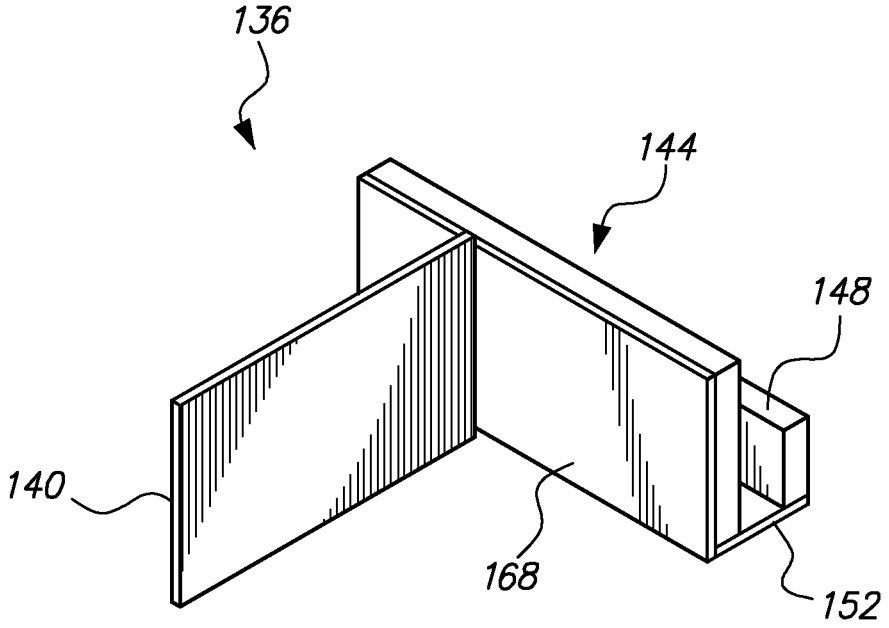
FIG. 2 is a perspective view of an exemplary hidden compartment assembly.

FIG. 2 is a perspective view of an exemplary hidden compartment assembly 136. As stated, the hidden compartment assembly 136 may comprise a divider 140 and a holder 144. The holder 144 may comprise a front 168, a back 148, and a bottom 152, such as shown. In this manner, items 144 may be placed into and stored in the holder 144. For instance, as shown, the front 168, back 148, and bottom 152 form a storage area configured to retain one or more items placed therein. For example, one or more envelopes could be placed into the storage area. Other items could be placed in the storage area as well.

It is noted that the holder 144 may have sides in some embodiments, such as to prevent items from falling out of the holder at its sides. In addition, in some embodiments, the holder 144 may be enclosed such as to provide added security. For example, the holder 144 may be a box or other container having one or more doors, access panels, lids, covers or the like that may be removable to access the items stored therein. In such embodiments, the holder 144 may have a locking mechanism, having one or more keys, combinations or other ways of secured access.

As can be seen, the divider 140 may attach to and extend from a front 168 of the holder 144. Referring to FIG. 1B, this allows the holder to be reached from a front end of the undercabinet secretary 104. In other words, the holder 144 may be retrieved at the front of the undercabinet secretary 104 via the divider 140. In addition, the divider 140 helps hide the fact that there is a hidden compartment assembly 136 since the divider 140 may be constructed with the same materials and in the same or similar manner as the other dividers 132.

In one or more embodiments, the divider 140 may have a height larger than that of the holder 144. To illustrate, as can be seen in FIG. 2, the divider 140 extends a distance beyond the top and bottom end of the holder 144. This allows the divider 140 to engage a channel 124 at the top 108 and bottom 112 of the undercabinet secretary 104. In other words, by having an increased height the top and bottom end of the divider 140 may extend into channels 124A of the top 108 and bottom 112. Since the holder 144 has a smaller height, it can fit between the top 108 and bottom 112 and be movable therebetween.

In general, the height of at least the front 168 of the holder 144 will be the same or substantially similar to the distance between the top 108 and bottom 112 of the undercabinet secretary 104. This makes it more difficult to discern the existence of the holder 144, even if a person were to look directly at it. This is because the holder 144 would appear to be part of the back 128 of the undercabinet secretary 104 and there would be little or no gap between the front 168 of the holder 144 and the top 108 or bottom 112 of the undercabinet secretary 104. In one or more embodiments, this "snug" fit also helps hold the hidden compartment assembly 136 in place through friction.

Figure 3A:
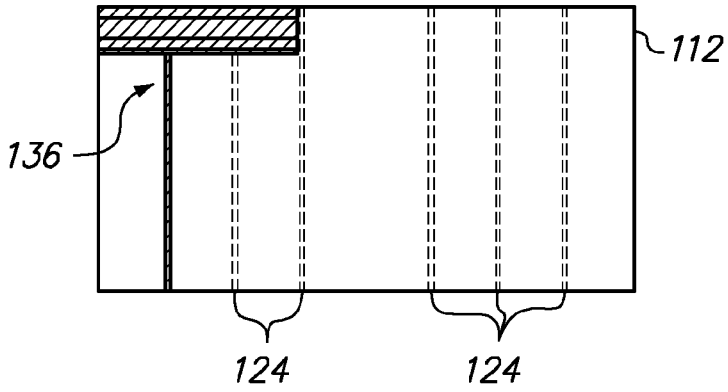
FIG. 3A is a top interior view of an exemplary undercabinet secretary in use.
Figure 3B:
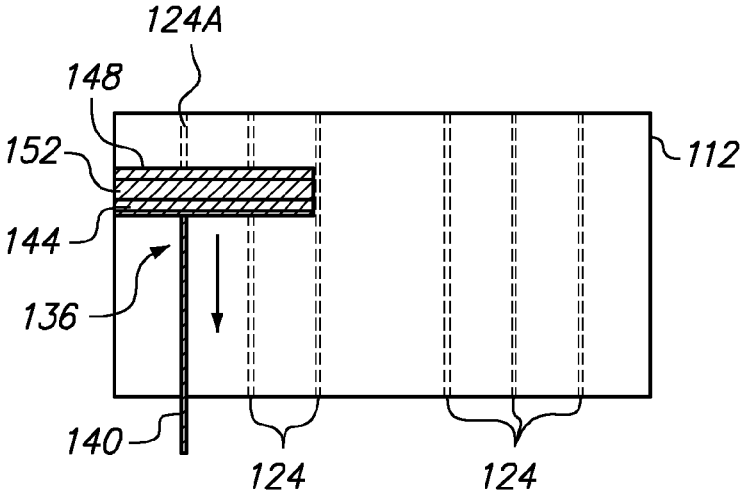
FIG. 3B is a top interior view of an exemplary undercabinet secretary in use.
Figure 3C:
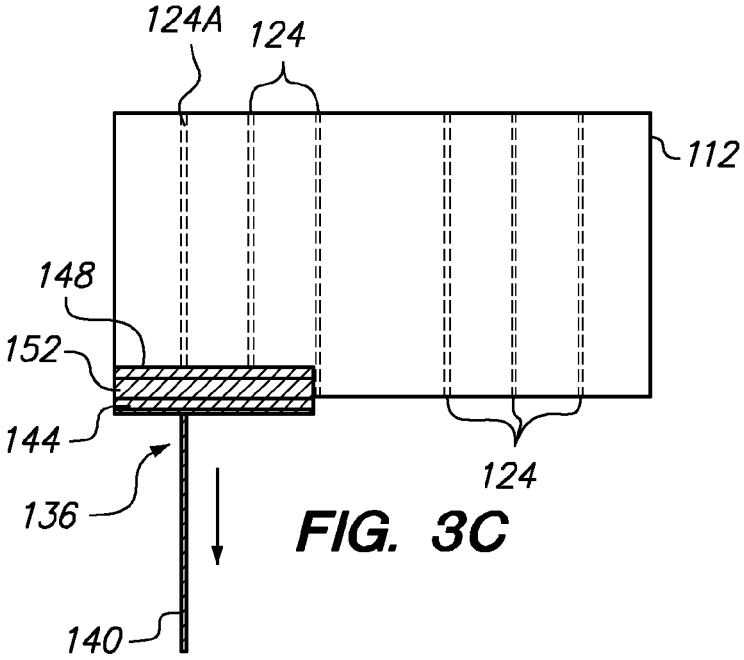
FIG. 3C is a top interior view of an exemplary undercabinet secretary in use.

Operation of the undercabinet secretary 104 will now be described with regard to FIGS. 3A-3C. FIGS. 3A-3C provide a top view of the undercabinet secretary 104. The top 108 has not been illustrated so that the inner workings of the undercabinet secretary 104 can be seen. The channels 124 disclosed above are shown in the bottom 112 of the undercabinet secretary 104.

It can be seen from FIG. 3A, that the hidden compartment assembly 136 may be situated such that its divider 140 is flush with other dividers and/or with the front edge of the undercabinet secretary 104. This conceals the hidden compartment assembly 136 since it appears to be just like any other divider. In this position, the holder 144 of the hidden compartment assembly 136 may be positioned at the back of the undercabinet secretary 104. Any items stored in the hidden compartment assembly 136 would thus be held at the back of the undercabinet secretary 104 for safekeeping.

As can also be seen, the divider 140 of the hidden compartment assembly 136 may be shorter than the other dividers 132 (see FIGS. 1A-1C) such that both types of dividers may be located at similar positions (e.g., flush with the front end of the undercabinet secretary). This is beneficial in that it allows the divider 140 of the hidden compartment assembly 136 to blend in with the other dividers 132 so as to not be readily noticed or visible.

It is noted that since the holder 144 may extend across one or more channels 124, one or more of the other dividers 136 may the same or similar length as the divider 140 of the hidden compartment assembly. As can be seen from FIG. 3A, to this permits the other dividers 136 to accommodate the size of the holder 144.

When access to the holder 144 is desired, the hidden compartment assembly 136 may be moved outward. In one or more embodiments, this may occur by sliding or otherwise moving the divider 140 within one or more channels 124A in the top 108 and/or bottom 112 of the undercabinet secretary 104. As shown in FIGS. 3B-3C for example, the divider 140 is moved forward out of the front of the undercabinet secretary 104. This in turn moves the holder 144 out of the undercabinet secretary 104 thus making it and any items stored therein accessible. It is noted that the hidden compartment assembly 136 may be moved backward as well in some embodiments. In this manner, the holder 144 may be pushed or otherwise moved out the back of the undercabinet secretary 104 and be accessible at the back of the undercabinet secretary. If installed against a wall, which may be typical, it is contemplated that the undercabinet secretary 104 may be detached and/or moved away from the wall to allow access to the back of the undercabinet secretary 104.

Once the holder 144 is outside the undercabinet secretary 104 (i.e., accessible), one or more items may be removed and/or placed therein. The hidden compartment assembly 136 may then be returned to its original state, such as that shown in FIG. 3A. For example, the hidden compartment assembly 136 may be moved back to a position where its divider 140 matches the position of other dividers. This conceals the hidden compartment assembly 136 once again. It is noted that the hidden compartment assembly 136 may be moved in various ways. Since the divider 140 extends outward it may be used as a handle to push or pull the hidden compartment assembly 136. Alternatively or in addition, a user may push or pull on to the holder 144 to move the hidden compartment assembly 136.

It is noted that the other dividers 132 (see FIGS. 1A-1C) may also be slidable or movable within their channels 124. Alternatively the other dividers 132 may be fixed or secured to the top 108 and/or bottom 112 of the undercabinet secretary 104. In some embodiments, the other dividers 132 need not be in channels 124 and may be attached directly to the top 108 and/or bottom 112 without the channels.

As can be seen in FIGS. 3A-3C, the holder 144 may extend across one or more channels 124 of the undercabinet secretary 104. This provides an expanded area in which to store items. In one or more embodiments, the holder 144 will typically extend a lateral distance across the undercabinet secretary 104, which ends at a channel 124 so that it does not extend partially into a compartment 164 (see FIG. 1B). As can be seen for example, the holder 144 ends at the third channel 124 from the left. This helps conceal the holder 144 since the holder will not extend partially into a compartment 164 and thus be visible if one were to look inside the compartment.

It is noted that the hidden compartment assembly 136 may be positioned at various locations of the undercabinet secretary 104. For example, rather than at the left side of the undercabinet secretary 104, the hidden compartment assembly 136 may be at the right side or be centrally located. The divider 140 of the hidden compartment assembly 136 may engage an appropriate channel 124 of the top 108 and/or bottom 112 to accomplish this positioning. In addition, the position of the divider 140 relative to the holder 144 may be adjusted to ensure that the holder does not extend partially into a compartment 164 when located at various positions.

Figure 4A:
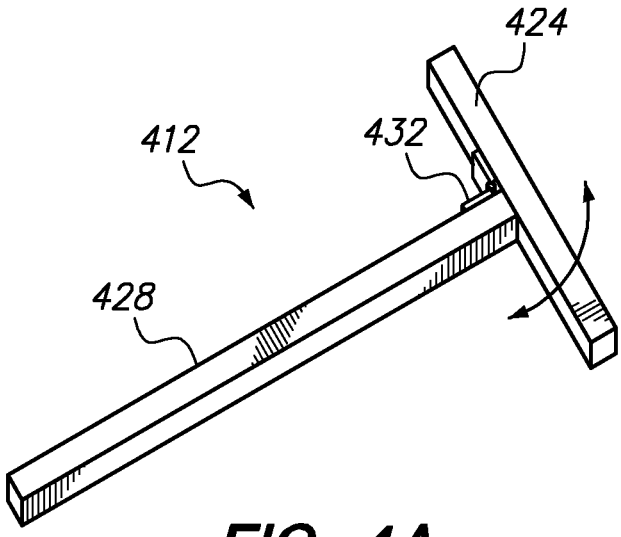
FIG. 4A is a perspective view of an exemplary installation tool for use in installing an undercabinet secretary.
Figure 4B:
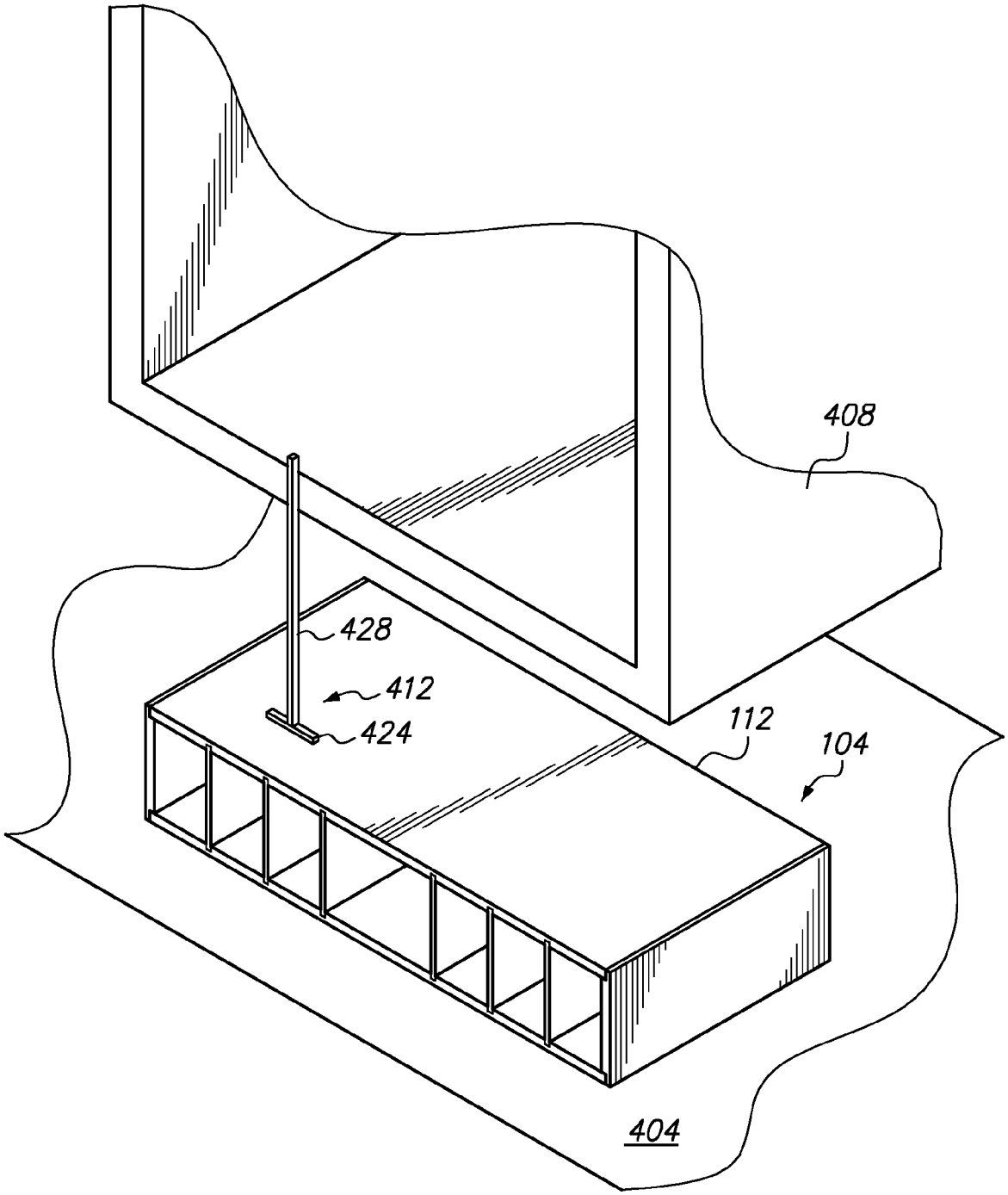
FIG. 4B is a perspective view illustrating use of an exemplary installation tool in installing an undercabinet secretary.
Figure 4C:
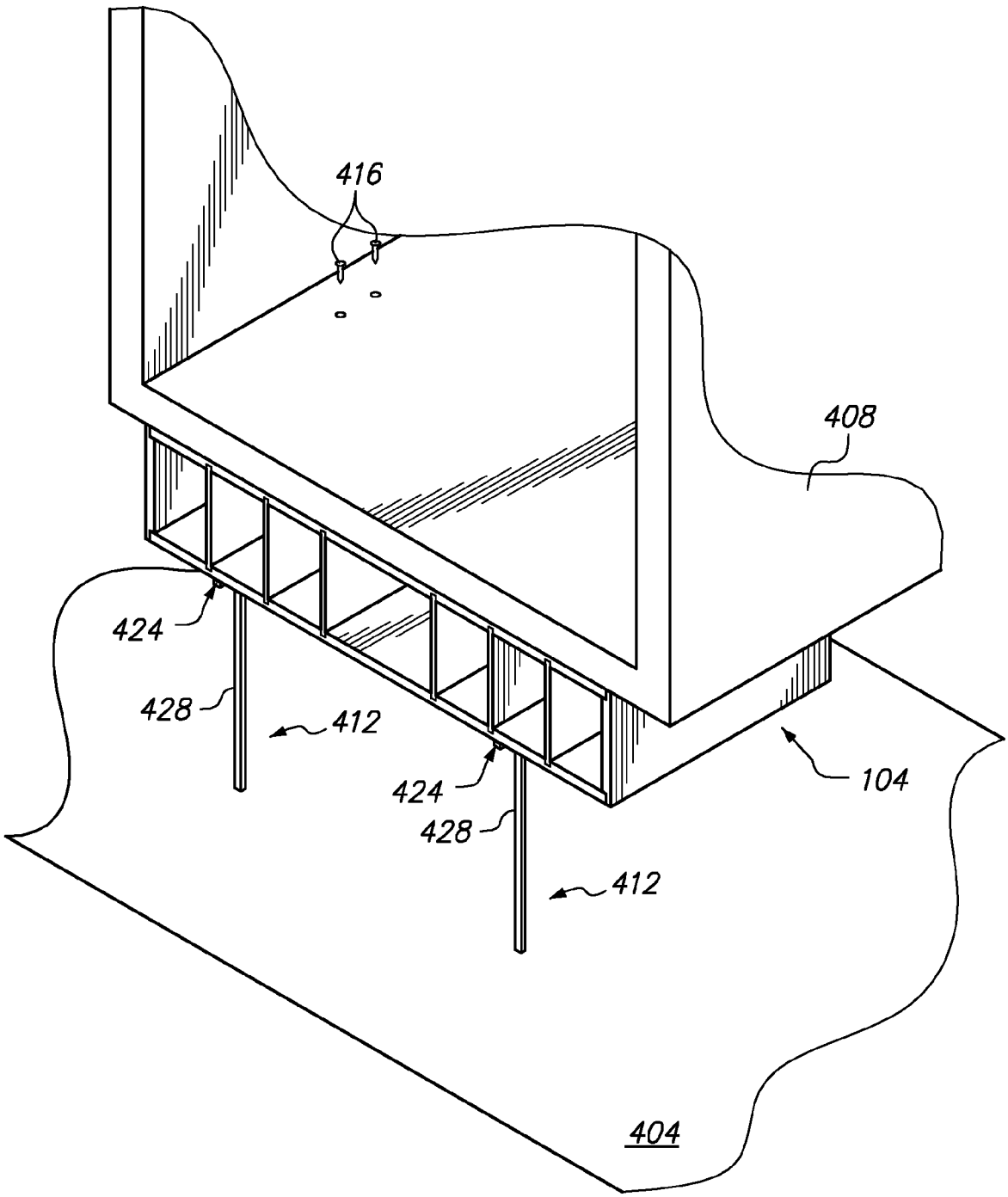
FIG. 4C is a perspective view illustrating use of an exemplary installation tool in installing an undercabinet secretary.

FIGS. 4A-4C illustrate an exemplary installation procedure for installing the undercabinet secretary 104. As can be seen, the undercabinet secretary 104 may be secured beneath a fixture 408, such as a cabinet or other structure. In one or more embodiments, at least one outer surface of the undercabinet secretary 104 may be configured to match that of the fixture 408, such as to blend in with the fixture. For example, the undercabinet secretary 104 may be painted, stained, and/or include similar materials as a fixture 408 to match the appearance of the fixture. In addition, the undercabinet secretary 104 may be sized to match the fixture 408. For example, (though not shown) the width of the undercabinet secretary 104 may match that of its fixture 408.

As will now be described, one or more installation tools 412 may be provided with the undercabinet secretary 104 to allow the undercabinet secretary to be easily installed by one person. Referring to FIG. 4A, which provides a perspective view of an exemplary installation tool 412, it can be seen that the installation tool 412 may comprise a base 424 and a support strut 428. These components may be configured as elongated members, such as shown. In general however, the base 424 provides an enlarged surface area for engaging and supporting the undercabinet secretary 104 while the support strut 428 contacts a supporting surface 404 (such as a countertop) to hold the undercabinet secretary at an elevated position. In this manner, the installation tool 412 raises the undercabinet secretary 104 so that it may be easily secured at an elevated position, such as under a fixture 408.

The base 424 and support strut 428 may be attached by a pivot 432 in one or more embodiments. Thus, as shown by the arrow of FIG. 4A, the base 424 may rotate relative to the support strut 428, such that they are at various angles relative to one another. For example, the base 424 and support strut 428 may be positioned parallel to one another or perpendicular to one another (or at various other angles). This is advantageous in that it permits the installation tool 412 to be in a parallel configuration to save room during packaging and/or shipping.

Typically, the base 424 and support strut 428 will be constructed from rigid materials. It is contemplated that the support strut 428 may be made from a material that can be easily cut. For example, the support strut 428 may be a soft wood or plastic that can be cut with sufficient scissor. The advantage of this will now be described with regard to FIGS. 4B-4C.

In FIG. 4B, the installation tool 412 is being used to establish a height at which the undercabinet secretary 104 will be installed. In this case, the undercabinet secretary 104 is to be attached to the bottom of the fixture 408. The undercabinet secretary 104 may be placed on a surface 404, such as a counter top in this case. The installation tool 412 may then be place on top of the undercabinet secretary 104 with its base 424 in contact with the undercabinet secretary and its support strut 428 extending downward therefrom perpendicular or substantially perpendicular to the base.

The support strut 428 may be cut (or otherwise shortened) such that it spans the distance between the base 424 and the fixture 408 (or location where the undercabinet secretary is to be installed). Support struts 428 of one or more installation tools 412 may be cut in this manner to provide support for the undercabinet secretary 104 during installation at one or more locations. It is noted that the support struts 428 may have perforations, detents, channels or the like cut therein at various locations along their length. In this manner, a portion of a support strut 428 may break away to shorten the support strut. It is contemplated that the perforations or the like may be positioned to take into account typical installation heights for the undercabinet secretary 104. For example, if a typical cabinet (or other fixture) is usually mounted a certain distance above a counter top (or other surface), perforations may be in the support strut 428 at a corresponding location to support the undercabinet secretary 104 such that the undercabinet secretary may be mounted to the bottom of the cabinet.

Referring to FIG. 4C, it can be seen that once the installation tools 412 are shortened they may be positioned beneath the undercabinet secretary 104, such as shown. The support struts 428 and base 424 provide vertical support for the undercabinet secretary 104 in this manner, while surrounding structures, such as the fixture 408 and/or wall behind the fixture may provide horizontal support. The base 424 may also provide some horizontal support in that the enlarged surface area contact between the base and the undercabinet secretary may prevent the undercabinet secretary from moving horizontally during installation. A single user can thus lift the undercabinet secretary 104 and position one or more installation tools 412 beneath the undercabinet secretary.

Once the undercabinet secretary 104 is supported, one or more fasteners 416 may be installed to secure the undercabinet secretary. For example, as shown, one or more fasteners 416 such as screws may be used to secure the top of the undercabinet secretary 104 to the fixture 408. It is noted that fasteners 416 may be used at the back and/or sides of the undercabinet secretary 104 as well to secure the undercabinet secretary to adjacent structures.

It is contemplated that the undercabinet secretary 104 may be removable in one or more embodiments. For example, releasing the fasteners 416 may allow the undercabinet secretary 104 to be removed. The undercabinet secretary 104 may then be moved to another location and installed there. Alternatively, the undercabinet secretary 104 could be used as a stand alone fixture if such operation is desired. For example, the undercabinet secretary 104 could be place on a desk or other support surface and used at that location.

As can be seen, the undercabinet secretary 104 is advantageous in providing organization and storage to existing fixtures 408. In addition, the undercabinet secretary 104 has an added benefit in that it provides a hidden compartment assembly for concealing valuable, sensitive, confidential, or other items. Typically, the hidden compartment assembly will not, but may, be locked. In this manner, those who know of the hidden compartment assembly can quickly and easily retrieve and store items therein without the need for a key or combination code. At the same time, those who are unaware of the hidden compartment assembly will have no access to the items within the hidden compartment assembly, thus keeping the items away from such persons.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An undercabinet secretary comprising:

a base comprising a plurality of first channels;

a top comprising a plurality of second channels;

a back panel extending between the base and top at a back end of the undercabinet secretary, wherein the back panel is perpendicular to the plurality of first and second channels;

one or more dividers held by at least one of the first channels and at least one of the second channels and extending therebetween;

a holder having a bottom, a front and a back and configured to hold one or more items, the holder located at the back end of the undercabinet secretary, wherein the front of the holder is parallel with the back panel so that the front of the holder appears to be coplanar with the back panel to conceal the existence of the holder when viewed from a front end of the undercabinet secretary; and an additional divider extending from the front of the holder, the additional divider held by at least one of the first channels and at least one of the second channels and extending therebetween, wherein the additional divider is movable along the at least one of the first channels and the at least one of the second channels to permit the holder to be moved into and out of the undercabinet secretary.

2. The undercabinet secretary of claim 1 further comprising one or more side panels extending between the base and the top at one or more lateral ends of the base and the top.

3. The undercabinet secretary of claim 1, wherein an overall length of the additional divider and the holder is the same as a length of the one or more dividers.

4. The undercabinet secretary of claim 1, wherein the holder extends a distance across the base to end at one of the one or more second channels.

5. The undercabinet secretary of claim 1, wherein the additional divider has a height taller than that of the holder so that the additional divider may extend into at least one of the first channels and the at least one of the second channels.

6. The undercabinet secretary of claim 1, wherein at least one of the one or more dividers has a length the same as a length of the additional divider.

7. An undercabinet secretary comprising:

an enclosure having a top, a bottom, two sides, and a back panel, the top and the bottom both having a front end and a back end and the back panel extending between the top and the bottom to enclose a back end of the enclosure;

a plurality of first channels in the top and extending from the front end to the back end of the top;

a plurality of second channels in the bottom and extending from the front end to the back end of the bottom, wherein the plurality of first channels and the plurality of second channels open towards each other;

one or more dividers extending between the top and the bottom to form one or more compartments; and a hidden compartment assembly comprising:

a holder having a front, back and bottom, the holder located at the back end of the enclosure, wherein the front of the holder is parallel with the back panel so that the front of the holder appears to be coplanar with the back panel to conceal the existence of the holder when viewed from a front end of the undercabinet secretary; and an additional divider extending outward from the front of the holder, the additional divider having a top end and a bottom end, the top end within at least one of the plurality of first channels and the bottom end within at least one of the plurality of second channels, wherein the additional divider is movable within the at least one of the first channels and the at least one of the second channels to permit the holder to be moved into and out of the undercabinet secretary.

8. The undercabinet secretary of claim 7, wherein the additional divider is a planar structure.

9. The undercabinet secretary of claim 7, wherein the additional divider is slidable within the at least one of the one or more first channels and the at least one of the one or more second channels.

10. The undercabinet secretary of claim 7, wherein the one or more dividers are attached to the top and the bottom.

11. The undercabinet secretary of claim 7, wherein the additional divider has a height taller than that of the holder so that the additional divider may extend into at least one of the first channels and the at least one of the second channels.

12. The undercabinet secretary of claim 7, wherein the holder extends a distance across the base to end at one of the one or more second channels.

13. The undercabinet secretary of claim 7, wherein a length of the additional divider is shorter than a length of the one or more dividers to allow the hidden compartment assembly to be concealed within the undercabinet secretary.

14. The undercabinet secretary of claim 7 further comprising a front pivotably mounted to the front end of the base.

15. A method of concealing one or more items with an undercabinet secretary comprising:

placing a hidden compartment assembly comprising a holder having a divider extending outward therefrom within an enclosure having one or more compartments formed by one or more additional dividers therein;

positioning a front end of the one or more additional dividers at a front end of the enclosure, such that the one or more additional dividers extend from the front end of the enclosure to a back panel of the enclosure, the back panel enclosing a back end of the enclosure; and positioning a front end of the divider at the front end of the enclosure to conceal the holder of the hidden compartment assembly within the enclosure by:

engaging a first channel in a top of the enclosure with a top end of the divider;

engaging a second channel in a bottom of the enclosure with a bottom end of the divider, wherein the holder is held parallel to the back panel of the enclosure by the divider when the divider engages the first channel and the second channel; and moving the divider within the first channel and second channel to position the holder at the back end of the enclosure such that a front of the holder appears to be coplanar with the back panel of the enclosure to conceal the existence of the holder when the undercabinet secretary is viewed from its front end.

16. The method of claim 15 further comprising moving the hidden compartment assembly out of the enclosure and removing one or more items from the holder.

17. The method of claim 15 further comprising shortening a support strut of an installation tool.

18. The method of claim 17 further comprising pivoting a base of the installation tool relative to the support strut such that the support strut extends substantially perpendicular to the base, and supporting the enclosure at a particular location with the support strut of the installation tool.

19. The method of claim 18 further comprising securing the enclosure at the particular location with one or more fasteners, and removing the installation tool.

* * * * *